United States Patent [19]

Kawahara et al.

[11] Patent Number: 4,751,826

[45] Date of Patent: Jun. 21, 1988

[54] REFRIGERATOR

[75] Inventors: Kensaku Kawahara; Toshimasa Imaizumi, both of Ibaraki; Kouhei Kajimaru, Amagasaki, all of Japan

[73] Assignee: Kabushiki Kaisha Toshiba, Kawasaki, Japan

[21] Appl. No.: 95,981

[22] Filed: Sep. 14, 1987

[30] Foreign Application Priority Data

Sep. 12, 1986 [JP] Japan ..... 61-215500

[51] Int. Cl.[4] ..... F25D 25/02

[52] U.S. Cl. ..... 62/382; 62/441

[58] Field of Search ..... 62/440, 441, 382; 312/236

[56] References Cited

U.S. PATENT DOCUMENTS

| | | | |
|---|---|---|---|
| 2,064,926 | 12/1936 | Kuebler | 62/382 |
| 2,400,634 | 5/1946 | Earle | 62/383 X |
| 2,613,123 | 10/1952 | Patten | 62/382 X |
| 3,232,071 | 2/1966 | Wallenbrock et al. | 62/283 X |
| 3,254,502 | 6/1966 | Ellis | 62/382 X |
| 3,357,201 | 12/1967 | Toyama | 62/382 |
| 3,364,694 | 1/1968 | Cohen et al. | 62/382 X |
| 3,364,695 | 1/1968 | Saunders et al. | 62/382 |

FOREIGN PATENT DOCUMENTS

| | | |
|---|---|---|
| 60-251378 | 12/1985 | Japan . |
| 61-6579 | 1/1986 | Japan . |

*Primary Examiner*—Lloyd L. King

*Attorney, Agent, or Firm*—Cushman, Darby & Cushman

[57] ABSTRACT

A refrigerator includes a refrigeration chamber and a vegetable compartment communicating the refrigeration chamber through a cooled-air supply hole. A vegetable storage basket is arranged in the compartment such that it can be taken out through a front opening of the compartment. When the front opening is closed by a door, the basket is sealed and a cooled-air path, communicating with the cooled-air supply hole, is defined between the outer surface of the basket and the inner surface of the compartment. The basket has a moisture-permeable section located close to the supply port, for discharging moisture in the basket into the cooled-air flowing through the cooled-air path.

9 Claims, 3 Drawing Sheets

REFRIGERATOR

BACKGROUND OF THE INVENTION

The present invention relates to a refrigerator, and, more particularly, to a refrigerator provided with a vegetable compartment, with its own door which can be opened or closed, and a vegetable storage basket which fits into the vegetable compartment.

Conventional refrigerators include a type wherein a vegetable compartment, with its own door which can be opened or closed, is located under a refrigeration chamber. Cooled air is supplied from the refrigeration chamber to the vegetable compartment. In the vegetable compartment, a vegetable storage basket is provided, which is automatically moved in or out of the vegetable compartment in association with the movement of the door of the vegetable compartment.

In this type of conventional refrigerator, the storage basket is open on top, so as to permit the cooled air from the refrigeration chamber to enter the storage basket. However, the cooled air from the refrigeration chamber flows directly against the vegetables in the storage basket and removes the inherent moisture of the vegetables. As a result, the vegetables are apt to dry out in a short period of time. To solve this problem, it may be thought to close the top of the storage basket, so as to prevent the cooled air from directly contacting the vegetables. However, if the storage basket is sealed in this way, the refrigerator will have another problem. Specifically, the interior of the storage basket is apt to be saturated with moisture, because of the moisture entering the storage basket when the door is opened as well as the moisture emitted from the vegetables. If saturation occurs, the moisture in the storage basket will condense into drops of water, due to the temperature difference between the inside and outside of the closed storage chamber. If the water drops collect in the bottom of the storage basket, the vegetables would be immersed in the water, and their condition would deteriorate in a short time.

SUMMARY OF THE INVENTION

It is, accordingly, the object of the present invention to provide a refrigerator wherein the humidity of the interior of a vegetable storage basket can be maintained at an optimal level, thereby allowing reliable storage of vegetables for a long time.

To achieve this object, the refrigerator of the invention comprises:

a main body provided with a refrigeration chamber, a vegetable compartment with an open front section, and a cooled-air supply port, through which the refrigeration chamber and the vegetable compartment communicate with each other and which guides cooled air from the refrigeration chamber to the vegetable compartment;

a door for opening/closing the open front section of the vegetable compartment;

a vegetable storage basket located in the vegetable compartment such that it can be taken out through the open front section, the vegetable storage basket including an open section through which vegetables can be put in or taken out and defining a cooled-air path, which communicates with the cooled-air supply port, between the outer surface of the vegetable storage basket and the inner surface of the vegetable compartment when the door is closed; and means for closing the open section of the vegetable storage basket when the door is closed, the vegetable storage basket having a moisture-permeable section located in the vicinity of the cooled-air supply port for discharging excess moisture from the vegetable storage basket into a cooled air flowing through the cooled-air path.

BRIEF DESCRIPTION OF THE DRAWINGS

FIGS. 1 through 3 illustrate a refrigerator according to an embodiment of the present invention, in which:

FIG. 1 is an exploded, perspective view showing the vegetable compartment of the refrigerator;

FIG. 2 is a sectional view of the vegetable compartment; and

FIG. 3 is an enlarged perspective view of a moisture-permeable section.

DETAILED DESCRIPTION OF THE PREFERRED EMBODIMENTS

An embodiment of the present invention will be described in detail, with reference to the accompanying drawings.

Figure 1:
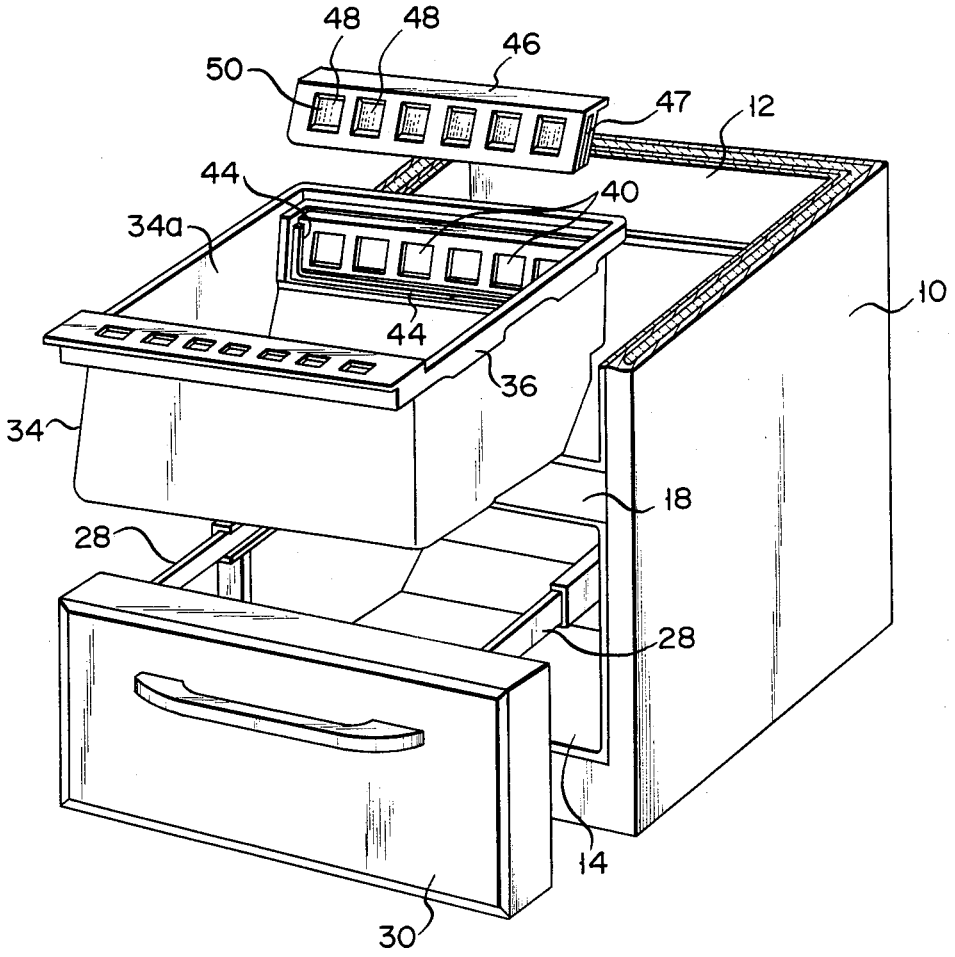
Figure 2:
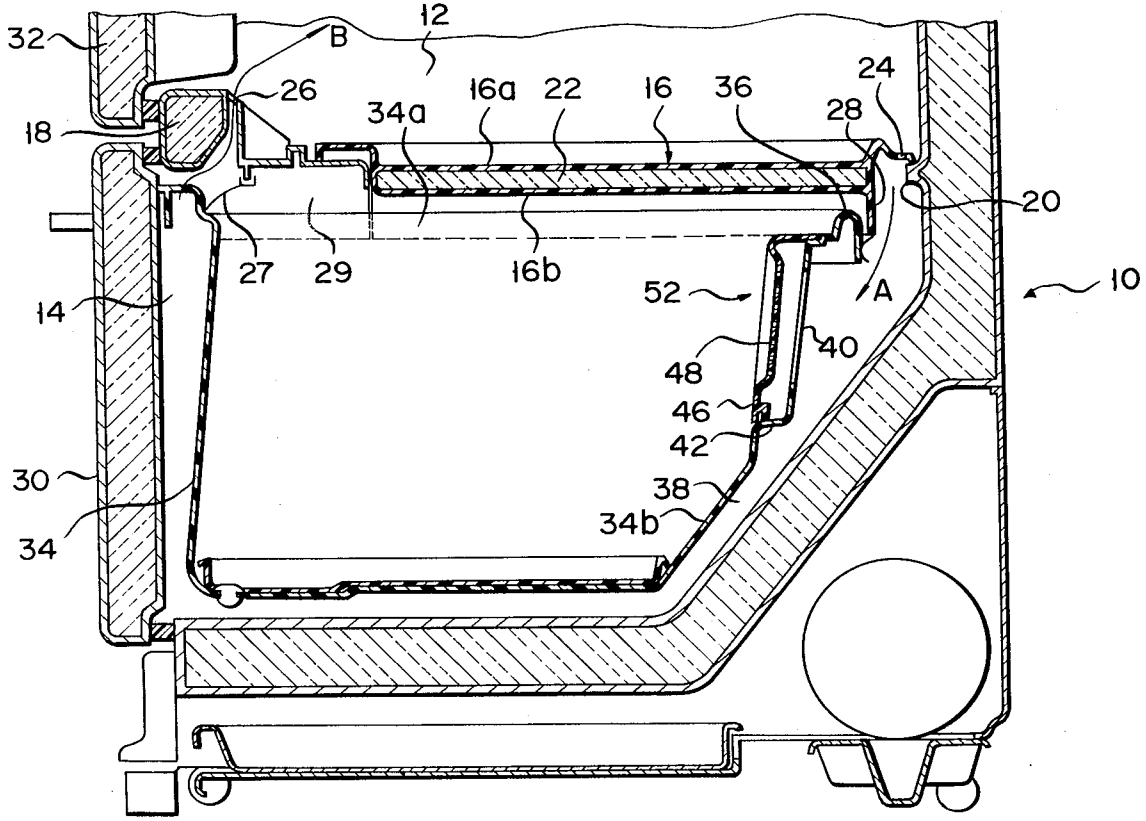

As shown in FIGS. 1 and 2, the subject refrigerator comprises main body 10. Main body 10 includes a freezer compartment (not shown), located uppermost, refrigeration chamber 12, located under the freezer compartment, and vegetable compartment 14, located under refrigeration chamber 12. The front section of each of these compartments is open. Refrigeration chamber 12 and vegetable compartment 14 are separated from each other by means of partitioning plate 16, which is located within main body 10. Partitioning frame 18 is provided in the front section of main body 10 such that it extends between the side walls of main body 10. Projection 20 is formed on the rear wall of main body 10 such that it projects into the interior of main body 10 and faces partitioning frame 18. The front end of partitioning plate 16 is mounted on the rear end portion of partitioning frame 18, while the rear end thereof is mounted on projection 20. Partitioning plate 16 comprises upper and lower plate **16*a* and 16*b*, made of plastic and facing each other, and heat insulator 22, filled between upper and lower plates 16*a* and 16*b*. Cooled-air supply ports 24, communicating with both refrigeration chamber 12 and vegetable compartment 14, are formed in that portion of partitioning plate 16 which is located in the vicinity of projection 20. Through ports 24, cooled air is supplied from refrigeration chamber 12 to vegetable compartment 14. Partitioning frame 18 is provided with air discharge holes 26, through which the cooled air is returned to refrigeration chamber 12 from vegetable compartment 14**.

On the lower surface of partitioning plate 16, elastic seal packing 28 is formed such that it extends along the lateral and rear sides of plate 16. On the lower surface of partitioning frame 18, seal packings 27 and 29 are formed such that packing 27 extends in the widthwise direction of main body 10 and packing 29 extends between the ends of packings 27 and 28.

A pair of guide rails (not shown), with a U-shaped cross section, are secured to the inner surfaces of the respective side walls of vegetable compartment 14. The guide rails extend horizontally and face each other. Telescopically movable rail 31 is supported by each guide rail through use of rollers (not shown), in such a manner that it is movable to and fro with respect to main body 10. Door 30, used for opening/closing the front section of vegetable compartment 14, is secured to the front ends of movable rails 31. When door 30 is opened or closed, rails 31 slide along the guide rails. The front section of refrigeration chamber 12 is opened or closed by means of door 32, which is swingable with reference to main body 10.

Vegetable storage basket 34, which is rectangular and has opening 34*a* on top, is located in vegetable compartment 14. Storage basket 34 has flange 36 extending along the periphery of top opening 34*a*. By mounting flange 36 on movable rails 31, storage basket 34 is supported in compartment 14. With the opening/closing of door 30, i.e., the sliding movement of movable rails 31, storage basket 34 moves to and fro with reference to main body 10, so that basket 34 can be moved in or out of vegetable compartment 14 through the open front section thereof. When door 30 is closed, flange 36 of storage basket 34 touches packings 27, 28 and 29 provided on partitioning plate 16 and partitioning frame 18, as is shown in FIG. 2. Therefore, top opening 34*a* of storage basket 34 is hermetically sealed by packings 27, 28, and 29 and partitioning plate 16. At the same time, cooled-air path 38 is defined between the outer face of storage basket 34 and the inner surface of vegetable compartment 14. Part of the cooled air in refrigeration chamber 12 flows into path 38 through ports 24, as indicated by arrow A. After flowing around storage basket 34 while cooling the interior of storage basket 34, the cooled air flows back into refrigeration chamber 12 through air discharge holes 26.

Figure 3:
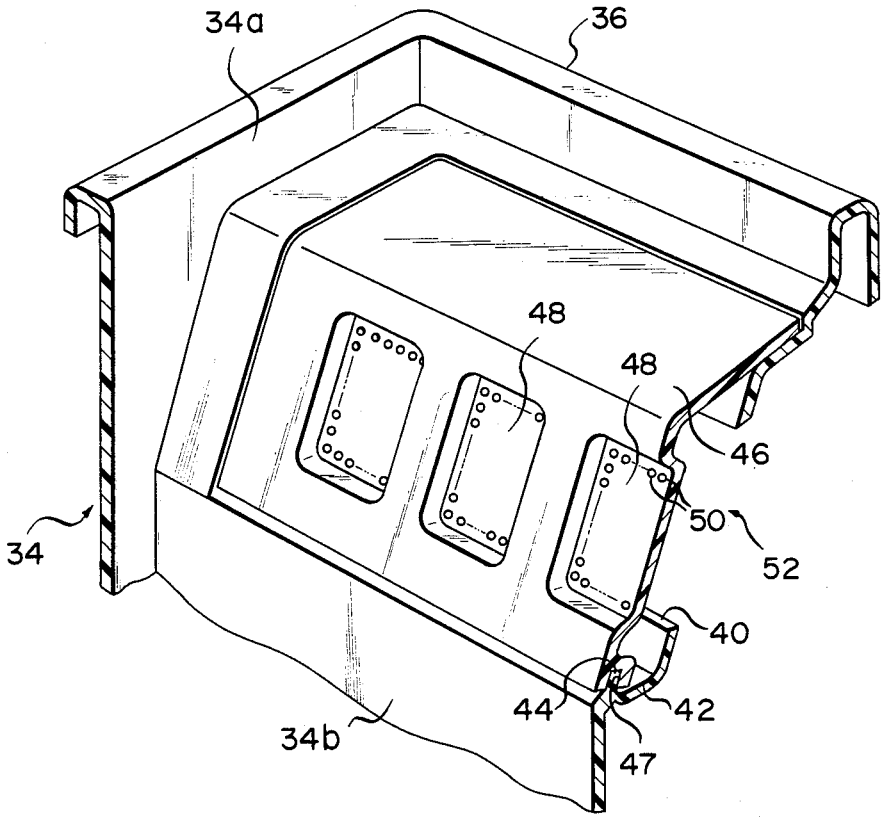

As is shown in FIGS. 1 through 3, that portion of storage basket 34 which is located in the vicinity of cooled-air supply ports 24 (i.e., the upper portion of rear wall 34*b* of storage basket 34) is spaced apart from the inner surface of vegetable compartment 14 more than the other portions of storage basket 34. In other words, path 38 for cooled air has a greater sectional area between the upper portion of rear wall 34*b* of storage basket 34 and the rear wall of vegetable compartment 14. The upper portion of rear wall 34*b* is provided with six rectangular air holes 40, which are spaced from each other in the widthwise direction of main body 10. The upper portion of rear wall 34*b* is also provided with stepped section 42, which is located under air holes 40 and protrudes into the interior of storage basket 34. Guide rib 44 is formed on stepped section 42 such that it extends in the widthwise direction of main body 10 while being spaced apart from air holes 40. The end portions of guide rib 44 extend upward along the inner surface of storage basket 34. Within storage basket 34, moisture-permeable plate 46 is provided such that it faces and covers air holes 40. Moisture-permeable plate 46 is formed of plastic and has a cross section shaped substantially like an "L". Groove 47 is cut along the periphery of plate 46. By engaging groove 47 with guide rib 44, moisture-permeable plate 46 is detachably fitted in storage basket 34.

Moisture-permeable plate 46 is provided with six rectangular depressed sections 48, which are depressed toward rear wall 34*b* of main body 10. Each depressed section 48 faces the corresponding air hole 40. A large number of moisture-permeable holes 50 are formed in the bottom of each depressed section 48. Each hole 48 has a diameter of 2 mm and a pitch of 4 mm. If the capacity of storage basket 34 is 50 liters, the total number of moisture-permeable holes 48 is set to about 200. Air holes 40 and moisture-permeable plate 46 constitute moisture-permeable section 52 of the present invention.

The operation of the refrigerator having the above construction will now be described.

When door 30 is closed, vegetable storage basket 34 is hermetically sealed by means of seal packings 27, 28 and 29 and partitioning plate 16. Therefore, cooled air, supplied from refrigeration chamber 12 into vegetable compartment 14 through cooled-air supply ports 24, flows through air path 38 located around storage basket 34, thereby cooling the interior of storage basket 34 from the outside thereof. As a result, the temperature of the interior of storage basket 34 is maintained at a value suitable for storing vegetables. The vegetables in storage basket 34 emit moisture as their temperature decreases. In addition, when door 30 is opened, part of the air in storage basket 34 is exchanged with the damp air from outside of the refrigerator. Therefore, the moisture content in storage basket 34 gradually increases.

With the present embodiment, however, the moisture can be discharged from storage basket 34 to the outside thereof in such a manner that the moisture in storage basket 34 can be maintained at an appropriate value. How the appropriate moisture content is achieved will be explained in more detail. Moisture-permeable plate 46 of storage basket 34 is located in the vicinity of air supply ports 24, so that the cooled air which has just been supplied from refrigeration chamber 12 touches moisture-permeable plate 46 after passing through air holes 40. As a result, moisture-permeable plate 46 is cooled more than other portions of basket 34. If the moisture difference between the inside and outside of storage basket 34 exceeds a predetermined value, the moisture in storage basket 34 condenses into drops of water, which attach to the inner surface of moisture-permeable plate 46. It should be noted that the cooled air which has just been supplied from refrigeration chamber 12 is comparatively dry and this dry air is flowing on the outer side of moisture-permeable plate 46. Therefore, the water drops attaching to the inner surface of moisture-permeable plate 46 are attracted to the dry, cooled air. As a result, the water drops pass through moisture-permeable holes 50 of moisture-permeable plate 46 and evaporate into the cooled air passing around storage basket 34. If each moisture-permeable hole 50 has a diameter of 2 mm, the water drops attaching to the area 8 mm from the circumference thereof are immediately discharged from storage basket 34, thereby always keeping that area dry. As a result, the humidity in storage basket 34 is maintained at a value suitable for storing vegetables, i.e., 45%. Incidentally, the humidity in storage basket 34 is about 80% immediately after the door is opened.

If partitioning plate 16 is not provided with heat insulator 22, lower plate 16*b* of partitioning plate 16 is cooled to a very low temperature, due to the cooled air in refrigeration chamber 12. As a result, the moisture in storage basket 34 condenses into drops of water and these drops of water form on the lower surface of lower plate 16*b*, due to the temperature difference between lower plate 16*b* and the interior of storage basket 34. In the present embodiment, however, heat insulator 22 is employed. This heat insulator prevents lower plate 16*b*, which is in contact with the air in storage basket 34, from becoming cooler than the interior of storage basket 34. Therefore, the moisture in storage basket 34 does not condense into drops of water which might attach to lower plate 16*b*. Thus, almost all drops of water attach to moisture-permeable plate 46 and moisture can be discharged from storage basket 34 efficiently.

As long as door 30 is closed, vegetable storage basket 34 is hermetically sealed by packings 27, 28 and 29 and partitioning plate 16. Therefore, the cooled air supplied into vegetable compartment 14 does not directly contact the vegetables in storage basket 34, and the inherent moisture of the vegetables is not removed to an excessive degree. In other words, they are kept from being dried. If the moisture content in storage basket 34 exceeds a predetermined value, moisture is discharged from storage basket 34 to the outside by means of moisture-permeable section 52, thereby preventing the moisture content in storage basket 34 from increasing excessively. Since drops of water do not collect in the bottom of storage basket 34, the vegetables are prevented from being immersed in water. It is therefore possible to store vegetables in storage basket 34 in a suitable condition for a long time.

The present invention is not limited to the above embodiment. Various changes and modifications may be made within the spirit of the invention.

In the above embodiment, moisture-permeable plate 46 with moisture-permeable holes 50 is detachably attached to storage basket 34. However, this construction may be replaced by forming moisture-permeable holes in the rear wall of the storage basket without using a moisture-permeable plate. Furthermore, the material of moisture-permeable plate 46 is not limited to plastic. Any kind of material may be used if it has a high thermal conductivity and permits moisture to be attached thereto in the form of drops of water. For example, moisture-permeable plate 46 may be formed of a metal such as iron. Still further, the means for closing the top opening of the vegetable storage basket is not limited to the above-mentioned seal packings. Any other means, e.g., a lid, may be employed as long as it closes the top opening of the storage basket reliably.

What is claimed is:

1. A refrigerator, comprising:

a main body provided with a refrigeration chamber, a vegetable compartment with a front opening, and a cooled-air supply port, through which the refrigeration chamber and vegetable compartment communicate with each other and which guides cooled air from the refrigeration chamber to the vegetable compartment;

a door for opening/closing the front opening of the vegetable compartment;

a vegetable storage basket located in the vegetable compartment such that it can be taken out through the front opening, the vegetable storage basket including an open section through which vegetables can be put in or taken out and defining a cooled-air path, which communicates with the cooled-air supply port, between an outer surface of the vegetable storage basket and the inner surface of the vegetable compartment when the door is closed; and means for closing the open section of the vegetable storage basket when the door is closed, the vegetable storage basket having a moisture-permeable section located in the vicinity of the cooled-air supply port, for discharging excess moisture in the vegetable storage basket into the cooled air flowing through the cooled-air path.

2. A refrigerator according to claim 1, wherein said moisture-permeable section includes a large number of moisture-permeable holes through which the interior of the vegetable storage basket communicates with the cooled-air path.

3. A refrigerator according to claim 2, wherein said vegetable storage basket includes a wall located in the vicinity of the cooled-air supply port, the moisture-permeable section includes an air hole formed in the wall and opened into the cooled-air path, and a moisture-permeable plate arranged in the vegetable storage basket to cover the air hole, with a certain distance maintained therefrom, the moisture-permeable hole being formed in the moisture-permeable plate and facing the air hole.

4. A refrigerator according to claim 3, wherein said moisture-permeable plate includes a plurality of depressed sections which face the air hole, and the moisture-permeable holes being formed in bottom of the depressed sections.

5. A refrigerator according to claim 4, wherein said moisture-permeable plate is detachably attached to the vegetable storage basket.

6. A refrigerator according to claim 3, wherein said moisture-permeable plate is formed of a material having a high thermal conductivity.

7. A refrigerator according to claim 1, wherein said main body includes a partitioning plate which separates the refrigeration chamber and the vegetable compartment from each other and faces the open section of the vegetable storage basket, and the closing means includes a sealing member fixed to the partitioning plate and hermetically touching a periphery of the open section of the vegetable storage basket.

8. A refrigerator according to claim 7, wherein said partitioning plate includes an upper plate located in the refrigeration chamber, a lower plate located in the vegetable compartment, and a heat insulator filled between the upper and lower plates.

9. A refrigerator according to claim 7, wherein said cooled-air port is formed in the partitioning plate.

* * * * *